United States Patent [19]

Springs et al.

[11] Patent Number: 4,922,083

[45] Date of Patent: May 1, 1990

[54] FLEXIBLE, ELONGATED POSITIVE TEMPERATURE COEFFICIENT HEATING ASSEMBLY AND METHOD

[75] Inventors: Daniel R. Springs, Martindale; Jesse Hinojosa, San Marcos, both of Tex.

[73] Assignee: Thermon Manufacturing Company, San Marcos, Tex.

[21] Appl. No.: 185,155

[22] Filed: Apr. 22, 1988

[51] Int. Cl.[5] ..... H05B 3/34

[52] U.S. Cl. ..... 219/549; 338/22 R

[58] Field of Search ..... 219/549, 548, 553, 552, 219/528; 338/22 R, 225 D, 212, 328; 29/611, 828

[56] References Cited

U.S. PATENT DOCUMENTS

| | | | |
|---|---|---|---|
| 3,243,753 | 11/1962 | Kohler | 338/31 |
| 3,351,882 | 11/1967 | Kohler et al. | 338/322 |
| 3,413,442 | 11/1968 | Buiting et al. | 219/390 |
| 3,861,029 | 1/1975 | Smith-Johannsen | 29/611 |
| 4,017,715 | 5/1977 | Whitney et al. | 219/553 |
| 4,037,082 | 7/1977 | Tamada et al. | 219/541 |
| 4,246,468 | 1/1981 | Horsma | 219/553 |
| 4,314,231 | 2/1982 | Walty | 338/328 |
| 4,330,703 | 5/1982 | Horsma et al. | 219/553 |
| 4,369,423 | 1/1983 | Holtzberg | 338/66 |

OTHER PUBLICATIONS

Owens-Corning Fiberglas, Fiberglas Conductive Roving, Dec. 7, 1983.

Hercules, Inc., Magnamite Graphite Fibers.

Fiber Materials, Inc., Electrically Semi-Conductive Yarns, Aug. 1981.

Celion Carbon Fibers material safety data sheet, Oct. 1985.

Stackpole, properties of Graphite Grade 2916, Mar. 1986.

Afikim Carbon Fibers, General Information.

Union Carbide, Thornel Product Information, revision 7.

*Primary Examiner*—Bruce A. Reynolds

*Assistant Examiner*—Marvin M. Lateef

*Attorney, Agent, or Firm*—Pravel, Gambrell, Hewitt, Kimball & Krieger

[57] ABSTRACT

A flexible heating cable and method using positive temperature coefficient conductive (PTC) polymeric material as the primary heat source with the PTC composition material being electrically and mechanically connected to substantially flat, preferably braided, electrical conductors. A covering of dielectric material preferably is used to electrically separate the cable from the environment. The cable construction improves the heat transfer from the PTC composition material to the environment, thereby increasing the power generated by the PTC composition material. Additionally, the cable construction improves the temperature distribution of the cable.

11 Claims, 1 Drawing Sheet

FLEXIBLE, ELONGATED POSITIVE TEMPERATURE COEFFICIENT HEATING ASSEMBLY AND METHOD

BACKGROUND OF THE INVENTION

1. Field of the Invention

The present invention relates to electrical heating cables that use positive temperature coefficient polymeric materials as self-regulating heating elements.

2. Description of the Prior Art

Electrically conductive thermoplastic heaters that exhibit a positive temperature coefficient (PTC) characteristic are well known in the art. These heaters generally used conductive polymers as the heat generating source. Other well known PTC heaters are those using doped barium titanate chips or disks rather than a conductive polymeric PTC composition.

In heaters of both types mentioned above, the temperature sensitive material of the heating element, either a conductive polymeric PTC composition (hereinafter referred to as PTC composition) or a doped barium titanate chip (hereinafter referred to as PTC chip), has a temperature limit essentially equal to the desired self-limiting temperature of the heating cable and undergoes an increase in temperature coefficient of resistance when this limit is reached, so that the resistance of such heating element increases greatly. The current flowing substantially decreases in response to the increased resistance, limiting the power output from the cable to thereby prevent overheating of the heating cable. The point at which this sharp rise in resistance occurs in the PTC chip heater is termed the Curie point or switching temperature and is fixed by the dopant material. The switching temperature of the PTC composition heater is generally determined by the degree of crystallinity of the polymer and the polymer melt point. It may be a rather well defined temperature, or depending upon the polymer, it may take place over a temperature range and be somewhat less precise.

Generally, the conductive thermoplastic material used to make PTC composition heaters is produced by compounding carbon black particles and a crystalline thermoplastic polymer in a suitable blender. Typically, the blended material is extruded upon two or more spaced apart conventional, round, stranded bus wires, to form a heater matrix core, as shown in FIG. 1. A variety of other processing operations may take place following the extrusion process, such as the application of an electrically insulating jacket, annealing, cross-linking, etc. Heating cables are often supplied to the end user with an outer braided metallic jacket of copper, tinned copper or stainless steel which is applied over the primary electrical insulation covering the PTC composition heater. Generally, a protective overjacket of polymeric material is then extruded over the braid, especially if the braid is copper or tinned copper to prevent corrosion of the metallic braid.

Typically, the conductive compositions of polymer and carbon contain from about 4% to about 30% by weight of electrically conductive carbon black. Ideally, the conductive carbon black is uniformly dispersed throughout the matrix.

A practical description of how a PTC composition heating cable such as the one shown in FIG. 1 works is as follows: The bus wires are connected to an electrical power source and current flows between the buses through the conductive matrix. When the matrix is cool and dense the carbon particles are in contact, forming an electrically conductive network. When the matrix begins to heat up, the matrix expands and the conductive carbon network begins to break contact, disrupting the current flow and reducing the heating energy of the cable. As more of the carbon network is disrupted, the temperature drops, contracting the matrix, resulting in greater current flow and heat production. Eventually the cable reaches a self-regulated state reacting to the environment. Each point along the conductive matrix will adjust to its local temperature environment independently of the adjacent portion of the core material.

It has been recognized that by adjusting the heat transfer rate from a resistive heating element, the surface temperature can be changed. In a heater of a fixed resistance, of either a series of parallel configuration, the heater sheath or surface temperature is not at a constant temperature. The cable or heater sheath temperature varies according to the amount of power the heater produces, the heat transfer rate from the heater to the pipe or equipment, the heat transfer or surface area of the heater and the process temperature or temperature of piping to which the cable is applied. At a constant voltage, the power output of a "fixed resistance" heater will not vary, but the sheath temperature of the heater can vary greatly depending upon the overall heat transfer rate from the heater to the pipe or equipment surface. Different methods of attachment of heaters to a pipe with resulting differing heat transfer coefficients result in sheath temperatures of the fixed resistance heaters varying from the highest sheath temperature when only strapped to a pipe at regular intervals, to a lower temperature when covered with wide aluminum tape running parallel over the heater and holding the heater to the pipe, to an even lower temperature when attached to the pipe with a heat transfer compound.

In a PTC composition heater, there is no fixed energy output since the resistance is a function of the temperature of the conductive matrix. A higher or lower energy output can be obtained by changing the heat transfer rate from the conductive matrix to its surrounding environment.

When voltage is applied to a PTC composition heater, it will generate energy. If the heat transfer rate from the conductive matrix is low, then the heater will self-heat rather quickly and reach its switching temperature at a lower total output than would occur if a good means of heat dissipation were provided. Unlike a "fixed resistance" heater, an increase in supply voltage has very little effect on the output of a PTC composition heater.

A great number of PTC composition heater assemblies exist in the prior art. A number of these heaters were developed to provide low inrush current or to improve the power output of the PTC composition heaters. Generally, the assemblies have all been based on a layered concept which utilizes PTC composition materials and constant wattage (CW) or relatively constant wattage (RCW) materials in a layered or alternate configuration.

As previously stated, it was known that a reduction in sheath temperatures could be achieved by the application of heat transfer aids to the external surface of resistive heating cables. However, the heat transfer capabilities of heating cables were still limited, even with the use of external transfer improvements, because of internal heat transfer limitations. Better internal heat transfer was necessary to improve the heating characteristics of the cable.

Although it was known that flat electrodes, generally formed by a metallic mesh, grid or thin sheet, could be used to supply electrical power to the PTC composition material as shown in U.S. Pat. No. 4,330,703, the assemblies utilizing these prior flat electrodes still had low internal heat transfer properties because the electrodes were thin and had poor heat thermal transfer characteristics. Further, the heat producing materials in the cables were generally a combination of PTC compositions and CW materials, not single PTC compositions, resulting in increased costs. Additionally, the prior designs utilizing flat electrodes did not provide for easily embedding the electrodes in the PTC composition in an extrusion process, a low cost manufacturing process.

SUMMARY OF THE INVENTION

The heating cable of the present invention has substantially flat, preferably braided, electrical conductors having good thermal transfer characteristics disposed in overlying parallel relationship and encapsulated by a homogenous PTC conductive polymeric material in a single extrusion process, wherein the electrical conductors serve as the primary heat transfer means internally in the cable. Such construction results in a significantly better internal heat transfer compared to the prior art, thus allowing more heat to be removed from the PTC composition and cable.

Such improved heat transfer additionally improves the temperature distribution along the length of the cable because the heat is transferred along the electrical conductors, limiting the amount of local heat and improving the overall heat balance of the cable.

DESCRIPTION OF THE PREFERRED EMBODIMENT

Figure 1:
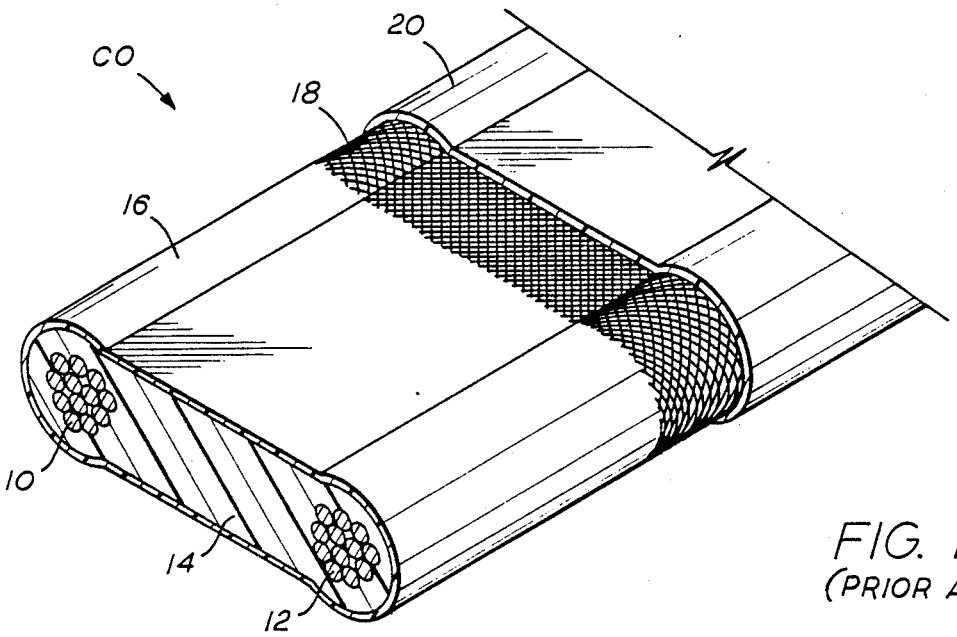
FIG. 1 (PRIOR ART)
FIG. 1 is a perspective view in partial cross-section of a heating cable constructed according to the prior art.

Referring to the drawings, the letter C generally designates the heating cable of the present invention with the numerical suffix indicating the specific embodiment of the cable C.

FIG. 1 illustrates a heating cable C0 constructed according to the prior art. Wires 10 and 12 were encapsulated in a PTC conductive polymeric material 14 to form the basic heating cable assembly. This assembly is surrounded by an insulating material 16 to provide the primary electrical insulation means for the heating cable C0. The primary insulation 16 is optionally covered by an outer braid 18 and further optionally covered by a protective polymeric overjacket 20 to fully protect the heating cable C0 and the environment.

Figure 2:
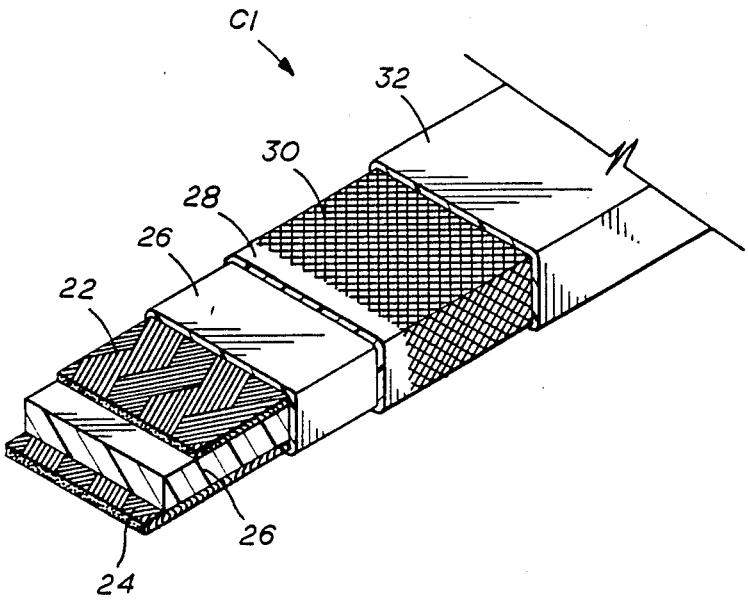
FIG. 2 is a perspective view in partial cross-section of a heating cable according to the present invention.

FIG. 2 illustrates the preferred embodiment of a heating cable C1 constructed according to the present invention. Flat, preferably braided, conductors 22, 24 are positioned parallel to each other in the longitudinal direction and spaced apart. The flat conductors 22, 24 are encapsulated in a homogeneous matrix of PTC conductive polymeric material 26 in a single extrusion process. The PTC composition material is blended and prepared using conventional techniques known to those skilled in the art. After the extrusion step is complete, an insulating layer 28 is applied to the extruded assembly to protect the heating cable C1 from the environment. Additionally, an optional outer braid 30 and a protective overjacket 32 can be applied to the cable C1.

Such construction results in the parallel flat conductors 22, 24 becoming a significant heat transfer means, even though the wire gauge size is the same as used in previous heating assemblies. The flat conductors 22, 24 have lower thermal resistance than the PTC composition material 26 and so more readily conduct substantially greater amounts of heat than the PTC composition material 26. The flat conductors 22, 24 also have a much lower thermal resistance and better coupling to the PTC composition material 26 than the round wire conductors 10, 12 of prior art, which conductors 10, 12 did not conduct substantial amounts of heat, but instead relied on the PTC polymeric material 14 to conduct the heat in the cable C0. Thus, by reason of this invention, more heat is transferred from the PTC composition material 26 and the heat is more evenly distributed along the length and width of the cable C1.

Figure 3:
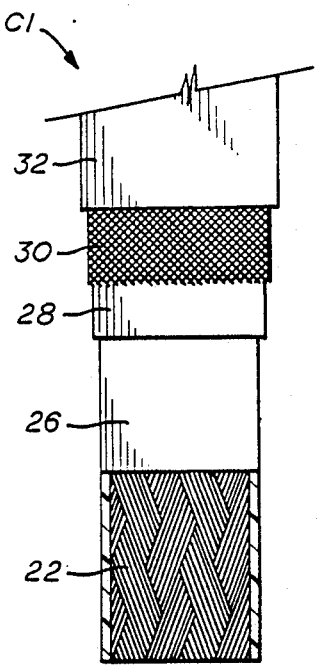
FIG. 3 is a cross-sectional top view of the heating cable of FIG. 2.

The conductors 22, 24 are preferably formed of braided copper wire formed in flat strips of a width approximating the width of the heater cable, as best seen in FIGS. 2 and 3. An exemplary conductor is a number 16 gauge copper wire which is 5/32 inches wide and 1/32 inches thick and is comprised of 24 carriers of 4 strands each, each strand being of 36 gauge wire, described as a 24-4-36 cable. This formation of the flat conductor is in contrast to conventional wires 10, 12 (FIG. 1) in which a 16 gauge copper wire is developed by utilizing 19 wires of number 29 gauge size. The conductors 22, 24 are alternately formed of aluminum or other metallic conductors formed into a braid. The individual strands may be coated with a tin, silver, aluminum or nickel plated finish.

In an alternate embodiment (not shown), the conductors 22, 24 are formed of a plurality of parallel, stranded copper conductors. The gauge of each of the individual wires is smaller than the gauge of the conductors in the prior art design, but the plurality of wires develops the desired overall wire gauge. The individual wires are placed parallel and adjacent to each other along the length of the cable to substantially form a flat conductor having properties similar to the braided wire.

Alternatively, the flat conductor can be woven from a plurality of carbon or graphite fibers, conductively coated fiberglass yarn or other similar materials of known construction as are commonly used in automotive ignition cables and as disclosed in U.S. Pat. No. 4,369,423. The fibers can be electroplated with nickel to further improve the conductivity of the fibers. Sufficient numbers of the fibers are woven to provide a flat conductor which is capable of carrying the necessary electrical loads.

The present invention additionally improves the electrical, as well as thermal, contact between the electric conductors 22, 24 and the PTC material 26. A typical flat bus in a number 16 gauge wire size is 5/32 inches thick and is made up of 24 carriers of 4 strands each of number 36 gauge wire braided together, in contrast to a conventional stranded round bus wire, where a typical 16 gauge wire size is provided in a 19/29 construction which represents 19 wires each, of number 29 gauge size, twisted together. The flat braided construction, with a greater number of wires braided into a crosshatched pattern and completely covered by the PTC composition material which is extruded between and somewhat over the flat, parallel conductors provides an improved electrical connection for the PTC composition material.

Example

A heating cable C0 as shown in FIG. 1 was constructed. A PTC conductive matrix 14 formed of a fluoropolymer with 11–14% by weight carbon black was extruded onto 16 gauge nickel-plated copper wires 10, 12 of 19/29 stranded construction. An insulating layer 16 was applied to complete the cable C0. The cable C0 was nominally classified as a 12 watt cable at 120 volts and 50° F. An 18 foot, 6 inch sample was prepared. The cable C0 was energized with approximately 110 volts at an ambient temperature of 78° F. When an equilibrium condition had been established, the current entering the cable C0 was approximately 1.7 amperes. This indicates that the cable C0 was producing approximately 10.3 watts per foot.

A cable C1 as shown in FIGS. 2 and 3 was constructed. An identical PTC composition material 26 as used in constructing the previously described cable C0 was extruded onto flat, braided 16 gauge copper conductors 22, 24 having a width of 5/32 inches and a thickness of 1/32 inches. An insulating layer 26 of the same material and thickness as in the previous cable C0 was applied to complete the construction of the cable C1. The assembly had an approximate thickness of 0.14 inches and an approximate width of 0.40 inches, excluding the insulating layer 26. The thickness was developed by having an approximate 0.02 inches of PTC composition material 26, a conductor 22 having an approximate thickness of 0.03 inches, a central PTC composition material 26 having an approximate thickness of 0.04 inches, followed by a conductor 24 having an approximate thickness of 0.03 inches and a layer of PTC composition material 26 having an approximate thickness of 0.02 inches. This cable C1 was also prepared in an 18 foot, 6 inches length and energized at approximately 110 volts in an ambient temperature of approximately 78° F. The equilibrium current measured approximately 3.7 amperes, which corresponds to approximately 22.4 watts per foot.

Therefore the present invention significantly improves the thermal conductivity of the cable so that the PTC composition material can produce greater power before going into a temperature self regulation mode.

It will be understood that because the heat is generated initially by the continuous PTC composition material, the cable may be selectively formed or cut into any desired length while still retaining the same watts per foot capability for the selected length.

The foregoing disclosure and description of the invention are illustrative and explanatory thereof, and various changes in the size, shape and materials as well as in the details of the illustrated construction may be made without departing from the spirit of the invention, and all such changes being contemplated to fall within the scope of the appended claims.

We claim:

1. An electrical heating cable, comprising:

first and second substantially flat, generally planar, elongated electrical conductor means each having two generally parallel faces and being substantially free of through openings, said conductor means superimposed with respect to each other but spaced from each other along the length of the cable for conveying electrical current and for conducting heat; and heating means comprising a positive temperature coefficient polymeric material disposed between and in contact with said conductor means and filling the space therebetween and also disposed externally of said conductor means for encapsulating said first and second conductor means, said polymeric material producing heat when current flows therethrough, said polymeric material substantially increasing in resistance when a temperature limit is reached to reduce the current flowing through said heating means and control the heat output of the cable, wherein each of said conductor means has a sufficient thermal conductivity so as to conduct substantial amounts of heat relative to said heating means.

2. The heating cable of claim 1, further comprising:

insulating material surrounding said heating means to protect the cable.

3. The heating cable of claim 2, further comprising:

an outer braid surrounding said insulating material.

4. The heating cable of claim 2, wherein each of said conductor means comprises braided wires.

5. The heating cable of claim 4, wherein said braided wire is formed of a plurality of copper wires.

6. The heating cable of claim 5, wherein said copper wires are plated.

7. The heating cable of claim 6, wherein the plating material is one of tin, silver, aluminum or nickel.

8. The heating cable of claim 1, wherein each of said conductor means comprises a plurality of electrically and thermally conductive fibers woven into substantially flat strips.

9. A method of assembling an electrical heating cable, comprising:

extruding a positive temperature coefficient polymeric material over first and second substantially flat, generally planar, elongated electrical conductors each having two generally parallel faces, being substantially free of through openings and of sufficient thermal conductivity to conduct substantial amounts of heat relative to said polymeric material, while the conductors are superimposed with respect to each other and spaced apart from each other with the polymeric material between and in contact with the conductors and filling the space therebetween, and encapsulating the exterior of the conductors during the extrusion and thereafter, said polymeric material producing heat when current flows therethrough and which substantially increases in resistance when a temperature limit is reached to reduce the current flowing through said polymer material and control the heat output of the cable.

10. The method of claim 9, wherein:

said conductors are a metallic braided material.

11. The method of claim 9, including the step of:

applying an outer insulation layer surrounding said polymer material and said conductors.

* * * * *

UNITED STATES PATENT AND TRADEMARK OFFICE

CERTIFICATE OF CORRECTION

PATENT NO. : 4,922,083

DATED : May 1, 1990

INVENTOR(S) : Daniel R. Springs, et al.

It is certified that error appears in the above-identified patent and that said Letters Patent is hereby corrected as shown below:

COLUMN 6

In Claim 9, Line 58, "polymer" should be "polymeric"

Signed and Sealed this

Twenty-eighth Day of January, 1992

*Attest:*

HARRY F. MANBECK, JR.

*Attesting Officer*

*Commissioner of Patents and Trademarks*